United States Patent [19]

Galton

[11] Patent Number: 4,737,994

[45] Date of Patent: Apr. 19, 1988

[54] GARMENT FOR PROTECTING WEARER AGAINST BONE FRACTURE

[76] Inventor: Harry A. Galton, 351 W. 245th St., Bronx, N.Y. 10471

[21] Appl. No.: 947,610

[22] Filed: Dec. 30, 1986

[51] Int. Cl.[4] ..... A41D 13/00

[52] U.S. Cl. ..... 2/2; 2/DIG. 3

[58] Field of Search ..... 2/DIG. 3, 1, 227, 2, 2/23, 114, DIG. 7, 69, 68; 128/DIG. 20, 132

[56] References Cited

U.S. PATENT DOCUMENTS 1,468,072 9/1923 Ogle ..... 2/23

2,607,934 8/1952 Bailhe ..... 2/DIG. 3

*Primary Examiner*—Doris L. Troutman

*Attorney, Agent, or Firm*—Robert E. Burns; Emmanuel J. Lobato

[57] ABSTRACT

A garment for protecting a wearer against bone fracture resulting from accidental falling comprises an undergarment to which is applied pocket-forming fabric comprising a pair of portions forming pockets positioned so as to overlie opposite hip regions of the wearer and a connecting portion extending along the waist line of the garment and forming a passage joining the two pockets. A seam joins the pocket-forming fabric portion with the garment along the waist line and along outer, lower and inner margins of the pocket-forming portions. A lower edge of the connecting portion is left free from the garment to provide an entrance to the pockets. An impervious inflatable bag inserted through the entrance into the pockets has an inflatable cushion-forming portion in each pocket and a connecting portion joining the cushion-forming portions. The bag is inserted in deflated condition and is then inflated to provide over each hip region of the wearer an air cushion for cushioning the impact in the event of a fall.

6 Claims, 2 Drawing Sheets

GARMENT FOR PROTECTING WEARER AGAINST BONE FRACTURE

FIELD OF INVENTION

The invention relates to an undergarment for protecting a wearer against bone fracture, resulting from accidental falling.

BACKGROUND OF THE INVENTION

Bone fracture as a result of accidental falling is a common occurrence with elderly people and in particular, people who have a calcium deficiency or people who are unsteady on their feet and have difficulty in walking. Such accidents occur for example, as a result of slipping on a wet or highly polished floor surface or tripping on objects, for example toys of play things, left on the floor. In elderly people, and in particular those with a calcium deficiency, bone fractures are very difficult to repair and may result in confinment to a wheel chair. Bone fractures resulting from falling thus represent a serious health problem.

SUMMARY OF THE INVENTION

It is an object of the present invention to provide a garment for protecting the wearer against bone fracture in the event of accidental falling. In accordance with the invention, the garment is provided in regions that are vulnerable to injury by falling and in particular hip regions with pockets for receiving inflatable pads which in the event of accidental falling, cushion the protected regions and thereby prevent fracture. In particular, the garment is an undergarment, as for example a slip, shorts, underwear or foundation. To the basic garment, there is affixed in the nature of a patch a pocket-forming fabric portion comprising a pair of portions for forming pockets positioned so as to overlie opposite hip areas of the body and a connecting portion extending along the waist line of the basic garment and forming a passage joining the pockets. The patch is secured to the basic garment by a seam joining the pocket-forming fabric portion with the basic garment along the waist line and along outer, lower and inner margins of the pocket-forming portions of the patch. A lower edge of the connecting portion between the pockets is left free from the basic garment to provide an entrance for inserting into the pockets an impervious inflatable bag having an inflatable hip-overlying portion in each of the pockets and a connecting portion joining the hip-overlying portions and received in the passage formed by the connecting portion of the patch. Appropriate means is provided for inflating the bag after it has been inserted into the pockets.

By cushioning the vulnerable portions of the body in the event of a fall, the garment in accordance with the present invention provides protection against bone fractures.

BRIEF DESCRIPTION OF DRAWINGS

The nature objects and advantages of a protective garment in accordance with the present invention will be more fully understood from the following description of preferred embodiments of the garment, illustrated by way of example in the accompanying drawings in which.

DESCRIPTION OF PREFERRED EMBODIMENTS

As illustrated by way of example in FIGS. 1 to 5 of the drawings, a protective garment in accordance with the present invention comprises an undergarment 1 shown in the form of a slip intended for ladies wear. The garment has a waist band 1.1 and a generally cylindrical fabric portion 1.2 extending down from the waste band. The garment is formed of suitable woven or knitted fabric having a certain amount of elasticity or stretchability, especially in a circumferential direction, so as to conform to the figure of the wearer. The undergarment 1 can be of any desired length and is shown by way of example as comming approximately to the knee of the wearer.

Figure 1:
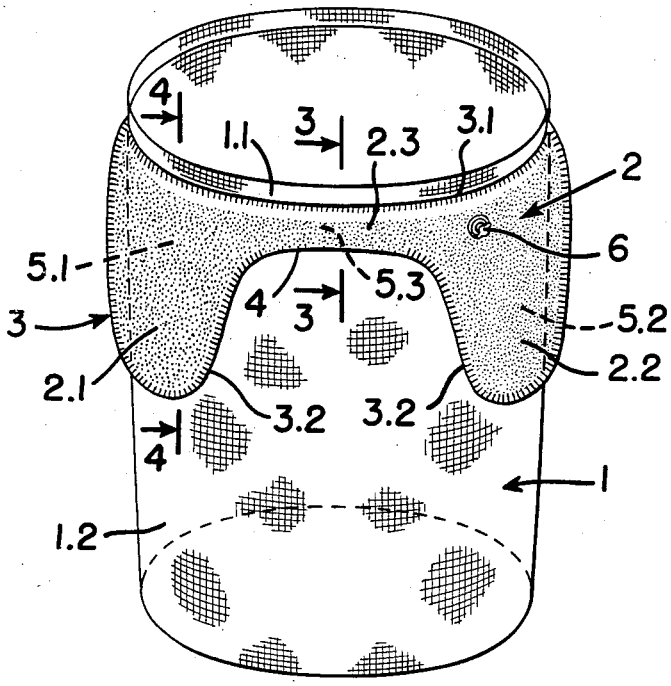
FIG. 1 is a schematic perspective view of a protective garment in accordance with the present invention in the form of a slip for ladies wear.
Figure 2:
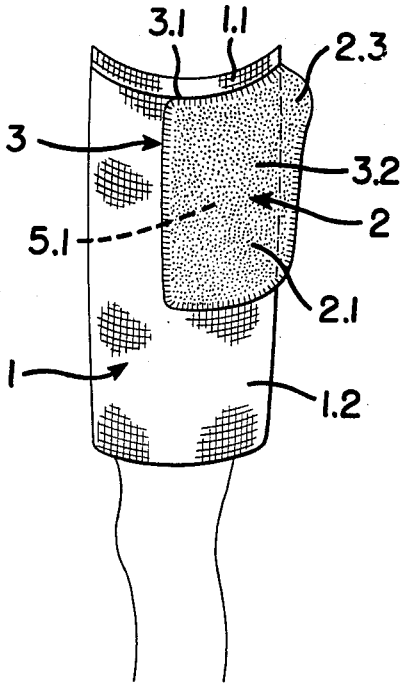
FIG. 2 is a schematic side view of the garment shown in FIG. 1.
Figure 3:
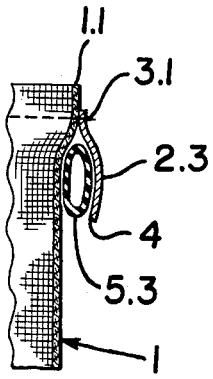
FIG. 3 is a schematic vertical section taken approximately on the line 3—3 in FIG. 1.
Figure 4:
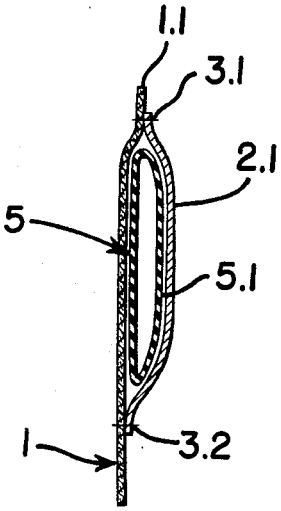
FIG. 4 is a schematic vertical section, taken approximately on the line 4—4 on FIG. 1.
Figure 5:
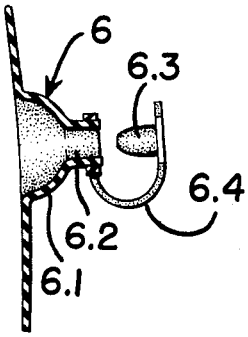
FIG. 5 is a schematic sectional view of a valve for inflation of an inflatable bag received in pockets of the garment.

To the undergarment 1, which is herein referred to as the "basic" garment, there is applied a "patch" of pocket-forming material 2 having two opposite pocket-forming portions 2.1 and 2.2 and a connecting portion 2.3. The pocket-forming portions 2.1 and 2.2 are positioned so as to overlie hip regions of the wearer. For example, each extends from the waist approximately halfway to the knee. In a circumferential direction, each extends from about the middle of the back of the leg, and the outside of the leg to about the middle of the front of the leg. Lower edge portions are curved as seen in FIG. 1. Pockets overlying hip regions of the wearer are thus formed between the basic garment 1 and the pocket-forming material 2. The connecting portion 2.3 extends along the waist line at the back of the garment and forms a passage connecting the two pockets.

The pocket-forming material 2 is secured at its periphery to the basic garment by stitching 3 comprising stitching 3.1, securing the upper edge of the pocket-forming material 2 to the waist line of the garment and stitching 3.2 which extends along the front, lower and rear edges of each of the pocket-forming portions 2.1 and 2.2. The lower edge 4 of the connecting portion 2.3 of the pocket-forming material 2 is left unattached and thus provides an entrance to the passage formed by the connecting portion 2.3 and the pockets formed by the pocket-forming portions 2.1 and 2.2 of the pocket-forming material 2.

An inflatable bag 5 of flexible impervious material, for example natural of synthetic rubber is inserted between the basic garment and the pocket-forming material 2. The inflatable bag 5 has two opposite cushion-forming portions 5.1 and 5.2 in pockets formed by the pocket-forming portions 2.1 and 2.2 of the pocket-forming material 2 and a connecting portion 5.3 disposed in the passage formed by the connecting portion 2.3 of the pocket-forming material 2. The inflatable bag 5 thus conforms in contour to the pocket-forming material 2. Moreover, by being formed of elastic or stretchable material, the inflatable bag 5 is capable of stretching with the basic garment 1 and the pocket-forming material 2. Means for inflating the inflatable bag 5 is shown by way of example as comprising a valve 6 which as shown by way of example in FIG. 5 comprises a nipple 6.1 having a neck portion 6.2 adapted to receive a resilient plug 6.3 attached to the nipple by a flexible band 6.4. The bag can be inflated by blowing or pumping air into through nipple 6.1 whereupon the plug 6.3 is pressed into the neck portion 6.2 of the nipple to retain the inflating air.

With the bag in uninflated condition, it is readily inserted through the entrance 4 into the pockets and connecting passageway formed by the pocket-forming material 2. The bag is then inflated through the valve 6, a small opening being provided in the pocket-forming material to provide access to the valve. When inflated, the bag provides two air cushions in position to overlie hip areas of the wearer. In the event of a fall, these air cushions cushion the impact so as to prevent bone fracture.

The bag 5 is readily deflatable by removing the plug 6.3 from the neck 6.2 of the nipple 6.1 so as to reduce the bulk of the garment, for example for packing. Moreover when the bag 5 is deflated, it can readily be removed from the garment through the opening 4. Thus the bag can be removed when the garment is to be laundered or dry cleaned. Moreover, the bag can be transferred from one garment to another so that only one bag is required for several garments.

Figure 6:
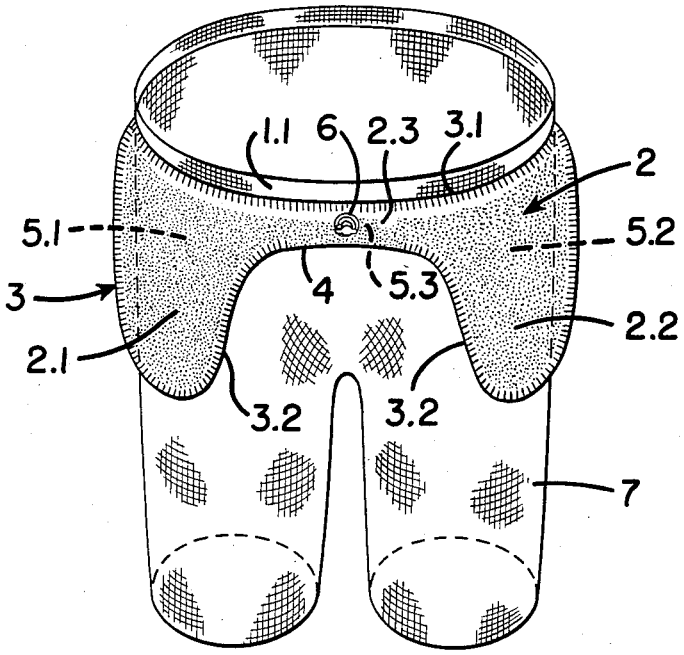
FIG. 6 is a schematic perspective view of a protective garment in accordance with the present invention in the form of shorts for ladies or men's wear.
Figure 7:
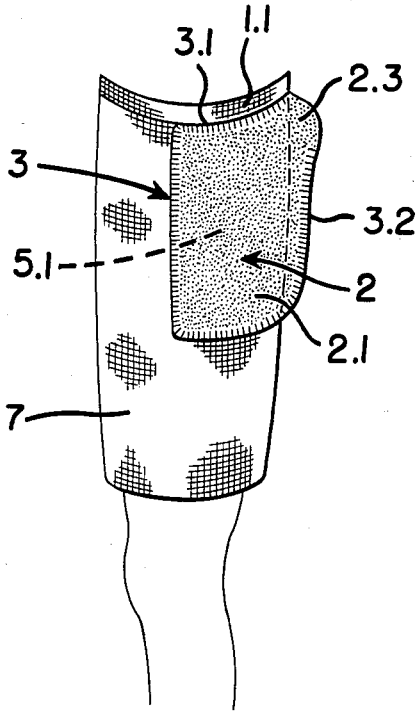
FIG. 7 is a schematic side elevation of the garment shown in FIG. 6.

In FIGS. 6 and 7, there is shown another embodiment of the invention in which the garment is in the form of shorts which can be worn by men or women. The construction of the garment is otherwise the same as that shown in FIG. 1 and corresponding parts are designated by the same reference numerals. However, the valve 6 is shown in a different position, being located in the connecting portion of the bag rather in one of the pockets.

Figure 8:
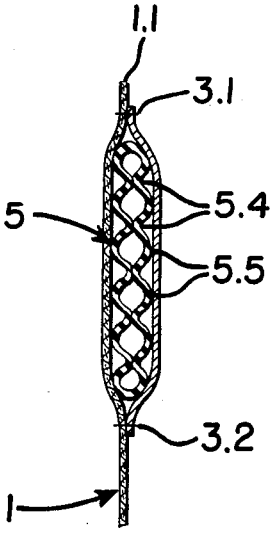
FIG. 8 is a schematic vertical section corresponding to FIG. 4 but illustrating a different inflatable bag construction.

In FIG. 8 there is shown schematically a bag construction in which opposite walls of the bag 5 are joined along spaced lines 5.4 so as to form in effect, a plurality of intercommunicating tubes 5.5. This construction limits expansion of the cushion-forming portions of the bag so that the bag can be inflated to higher pressure without unduly increasing the bulk of the garment.

What I claim is:

1. An undergarment for protecting a wearer against bone fracture resulting from accidental falling, said undergarment comprising a basic garment having a waist line and fabric portions extending down from the waist line including fabric portions covering hip regions of the body of a wearer, a pocket-forming fabric portion comprising a pair of portions for forming pockets positioned to overlie opposite hip regions of the wearer and a connecting portion extending along the waist line of said basic garment and forming a passage joining said pockets, a seam joining said pocket-forming fabric portion with said basic garment along the waist line and along forward, lower and rear margins of said pocket forming portions, a lower edge of said connecting portion being left free from said basic garment to provide an entrance to said pockets, an impervious inflatable bag inserted through said entrance into said pockets, said bag having an inflatable hip-overlying portion in each of said pockets, a connecting portion joining said hip-overlying porations and received in said passage, and means for inflating said bag and maintaining it in inflated condition.

2. An undergarment according to claim 1 in which said hip-overlying portions of said inflatable bag comprises a plurality of interconnected inflatable tubular portions disposed side-by-side.

3. An undergarment according to claim 1, in which said means for inflating said bag comprises a nipple and an attached plug removably insertable in said nipple.

4. An undergarment accordint to claim 1, in which said pockets are of an up-and-down extent to extend from the waist line of the wearer to approximately half way to the knee.

5. An undergarment according to claim 4, in which each of said pockets has a circumferential extent of at least approximately one guarter of the waist measurement of the wearer.

6. An undergarment according to claim 1, in which said pocket-forming fabric portion and said bag are stretchable in a direction circumferential of the garment to conform to the contour of the wearer.

* * * * *